US012168881B2

(12) United States Patent
Renz et al.

(10) Patent No.: US 12,168,881 B2
(45) Date of Patent: Dec. 17, 2024

(54) METHOD FOR ASSEMBLING AND DISMANTLING AT LEAST ONE SLAB TABLE FOR AT LEAST PARTIAL FORMWORKING OF A CONCRETE SLAB

(71) Applicant: PERI SE, Weissenhorn (DE)

(72) Inventors: Bernd Renz, Vohringen (DE); Martin Stoerk, Weissenhorn (DE); Werner Schneider, Erbach (DE)

(73) Assignee: PERI SE, Weissenhorn (DE)

( * ) Notice: Subject to any disclaimer, the term of this patent is extended or adjusted under 35 U.S.C. 154(b) by 0 days.

(21) Appl. No.: 18/061,781

(22) Filed: Dec. 5, 2022

(65) Prior Publication Data

US 2023/0175274 A1 Jun. 8, 2023

(30) Foreign Application Priority Data

Dec. 3, 2021 (DE) ..... 10 2021 131 957.9

(51) Int. Cl.

| | |
|---|---|
| ***E04G 11/52*** | (2006.01) |
| ***E04G 11/38*** | (2006.01) |
| *E04G 11/48* | (2006.01) |
| *E04G 11/50* | (2006.01) |
| *E04G 19/00* | (2006.01) |

(52) U.S. Cl.

CPC ..... *E04G 11/52* (2013.01); *E04G 11/38* (2013.01)

(58) Field of Classification Search

CPC ..... E04G 11/52; E04G 11/50; E04G 11/38; E04G 11/48; E04G 19/003; E04G 25/04; E04G 2025/003

See application file for complete search history.

(56) References Cited

U.S. PATENT DOCUMENTS

| | | | | |
|---|---|---|---|---|
| 3,977,536 A * | 8/1976 | Moore | ..... | E04G 19/003 425/62 |
| 10,907,364 B2 * | 2/2021 | Schneider | ..... | E04G 11/38 |
| 2019/0085571 A1 * | 3/2019 | Schneider | ..... | E04G 11/50 |

FOREIGN PATENT DOCUMENTS

| | | | | |
|---|---|---|---|---|
| CH | 413324 | | 5/1966 | |
| CH | 413324 A * | | 5/1966 | ..... E04G 11/48 |
| CH | 455238 A * | | 6/1968 | ..... E04G 19/003 |
| DE | 1759423 A1 * | | 6/1971 | ..... E04G 19/003 |
| DE | 7242089 U | | 2/1973 | |
| DE | 19602981 | | 10/1996 | |
| DE | 19602981 A1 * | | 10/1996 | ..... E04G 19/00 |
| DE | 19813789 | | 9/1999 | |
| DE | 19813789 A1 * | | 9/1999 | ..... E04G 11/483 |
| DE | 102016204633 A1 * | | 9/2017 | ..... E04G 11/38 |
| EP | 2463457 | | 6/2012 | |
| EP | 2463457 A1 * | | 6/2012 | ..... E04G 11/02 |
| FR | 2867497 | | 9/2005 | |

* cited by examiner

*Primary Examiner* — Bayan Salone

(74) *Attorney, Agent, or Firm* — SLEMAN & LUND LLP

(57) ABSTRACT

A method for assembling at least one slab table for at least partial formworking of a concrete slab, which has a carrier skeleton, at least one formwork element, and at least one support.

8 Claims, 10 Drawing Sheets

METHOD FOR ASSEMBLING AND DISMANTLING AT LEAST ONE SLAB TABLE FOR AT LEAST PARTIAL FORMWORKING OF A CONCRETE SLAB

FIELD

The invention relates to a method for assembling at least one slab table for at least partial formworking of a concrete slab. Furthermore, the invention relates to a method for dismantling at least one slab table, and to a shifting trolley.

BACKGROUND

It is known from practice to use formwork elements for producing concrete slabs. In this case, in particular frame panel formwork elements or panels are used, which at least partially form a mold for filling with liquid concrete. After the concrete has cured, the formwork elements are removed.

By means of formwork elements, slabs can be designed flexibly, since the slab formwork is composed of many individual formwork elements. To be able to quickly concrete large-area slabs, it has proven expedient, even for large room heights, to use slab tables which have a large formwork surface and, if applicable, a base frame. The adjustment can take place from below. Edge securing devices may already be mounted on the slab tables. The slab tables are generally completely pre-assembled and must be transported to the place of use by a crane. After the freshly concreted slab has cured, the slab table is brought to the next floor using a transportation fork or the like. The disassembly can take place only by means of transportation forks and open slab edges.

A disadvantage of the known slab tables is that they can be transported only in a cumbersome manner and used in an inflexible manner. Furthermore, known slab tables are often incompatible with other formwork elements. In addition, complex logistics and high crane capacities or high crane utilization are required.

DE 10 2016 204 633 A1 relates to a slab table for partial formworking of a concrete slab. The slab table has at least one formwork element—in particular, several formwork elements—which can be mounted on a base frame of the slab table and dismantled from the base frame in a non-destructive manner. The slab table has a carrier skeleton on which at least one formwork element—in particular, several formwork elements—is/are arranged. The carrier skeleton can have several struts which are designed such that they can be interconnected and separated from one another in a non-destructive manner. Preferably, the carrier skeleton has a pair of main girders—in particular, running parallel to one another—on which a pair of edge girders and at least one central girder arranged between the edge girders are arranged. Edge girders and central girders preferably run parallel to one another. The document further relates to a slab formwork having such a slab table.

SUMMARY

The object of the present invention is to provide a method for assembling or dismantling at least one slab table of the type mentioned at the outset, which avoids the disadvantages of the prior art, and in particular does not re-quire complex logistics and high crane utilization.

According to the invention, this object is achieved by a method for assembling at least one slab table for at least partial formworking of a concrete slab, which has a carrier skeleton, at least one formwork element, and at least one support, wherein the method comprises, in sequence or order, at least:

a) providing an—in particular, movable—shifting trolley or assembly and shifting trolley having a raisable and lowerable receiving device which is designed to receive the carrier skeleton of the slab table;
b) mounting the carrier skeleton of the slab table on the receiving device of the shifting trolley;
c) reversibly detachably fastening the at least one formwork element to the carrier skeleton of the slab table;
d) raising the carrier skeleton with the at least one formwork element;
e) mounting the at least one support on an underside, facing away from the at least one formwork element, of the carrier skeleton of the slab table;
f) positioning and aligning the shifting trolley at the intended mounting location of the slab table;
g) positioning the slab table at the assembly height by means of the raisable and lowerable receiving device;
h) adjusting the at least one support in order to place the slab table on the at least one support; and
i) lowering the receiving device and removing the shifting trolley.

By means of the measures according to the invention, the mounting and disassembly of the slab table can take place in a crane-independent manner at a safe working height. Nevertheless, use can be made of all the advantages of slab tables. The slab table can be mounted at a safe working height on a raisable and lowerable trolley that can be moved manually or automatically. The supports can be fastened under the tables by lifting. The tables can then be positioned at the height and in the position with the trolley. After the concreting operation, the tables can be dismantled again in the reverse sequence, without an open slab edge or a heavy crane or a transportation fork being required. For example, the removal could take place via a platform or the like arranged on the building. The slab table can be of modular design and can be assembled from supports as well as slab formwork elements in different sizes. The tables can be mounted directly on a shifting trolley. The assembly can thus be carried out at an ergonomic working height. By means of suitable receptacles, the table is oriented directly in the diagonals during assembly. An exact diagonal dimension of the slab table is of particular importance in the case of a slab formwork. Furthermore, after pre-assembly, the table can be brought to the appropriate height in order to mount the supports. Thereafter, the table can be moved to the place of use according to the height and position requirements. The disassembly takes place in reverse order. That is, always only lightweight individual parts are moved. The shifting trolley or lifting and transportation trolley can also be designed as a table lifter or a transportation fork. The formwork element can in particular be a frame panel shell element or panel. The formwork elements can have a formwork element frame and a formwork skin arranged on the formwork element frame. The panels can be 1 m×2 m or 2 m×66.6 cm in size. The slab tables can have, for example, a surface area of 4 m×6 m. The slab formwork, which comprises the slab tables, can have, for example, a surface area of 100 to 500 sq m.

Step b) can further comprise, as substeps in sequence:

b1) arranging a first main girder and a second main girder spaced apart therefrom in the receiving device of the shifting trolley, wherein the longitudinal axis of the first main girder runs parallel to the longitudinal axis of the second main girder; and b2) reversibly releasably fastening first and second edge girders to the main girders, wherein the longitudinal axes of the edge girders run perpendicular to the longitudinal axes of the main girders.

Furthermore, step b) can further comprise, as a substep—in particular, after step b2):

b3) reversibly releasably fastening at least one central girder to the main girders, wherein the longitudinal axis of the central girder runs parallel to the longitudinal axes of the edge girders.

The object according to the invention is further achieved by a method for dismantling at least one slab table of a formwork of a concrete slab, which has a carrier skeleton, at least one formwork element, and at least one support, wherein the method comprises, in sequence, at least:

a) providing an—in particular, movable—shifting trolley or assembly and shifting trolley having a raisable and lowerable receiving device which is designed to receive the carrier skeleton of the slab table;

b) positioning and aligning the shifting trolley at the installation location of the slab table to be dismantled;

c) positioning the raisable and lowerable receiving device at the mounting height of the slab table, and receiving the carrier skeleton of the slab table in the receiving device of the shifting trolley;

d) dismantling the at least one support;

e) lowering the carrier skeleton, provided with the at least one formwork element, of the slab table to a working height;

f) dismantling the at least one formwork element;

g) disassembling the carrier skeleton of the slab table; and h) removing the shifting trolley.

As a result of these measures, the slab table can be dismantled in the reverse sequence after the concreting operation.

A shifting trolley or assembly and shifting trolley for use in a method according to the invention, having a raisable and lowerable receiving device which is designed to receive a first main girder and a second main girder of a carrier skeleton of a slab table.

The shifting trolley can be provided with at least one winch, via which the receiving device can be raised and lowered.

In this case, the winch can be designed manually, e.g., via a crank or the like, or automatically—for example, electrically.

The receiving device can have holding regions which are adapted to a cross-sectional shape of the main girders.

As a result, the main girders can be easily placed in the holding regions, for direct mounting of the carrier skeleton on the shifting trolley.

Advantageous embodiments and developments of the invention emerge from the dependent claims.

BRIEF DESCRIPTION OF THE DRAWINGS

The principle of an embodiment of the invention is described below, with reference to the drawings.

DETAILED DESCRIPTION

In the figures, functionally identical elements are provided with the same reference signs.

Figure 1:
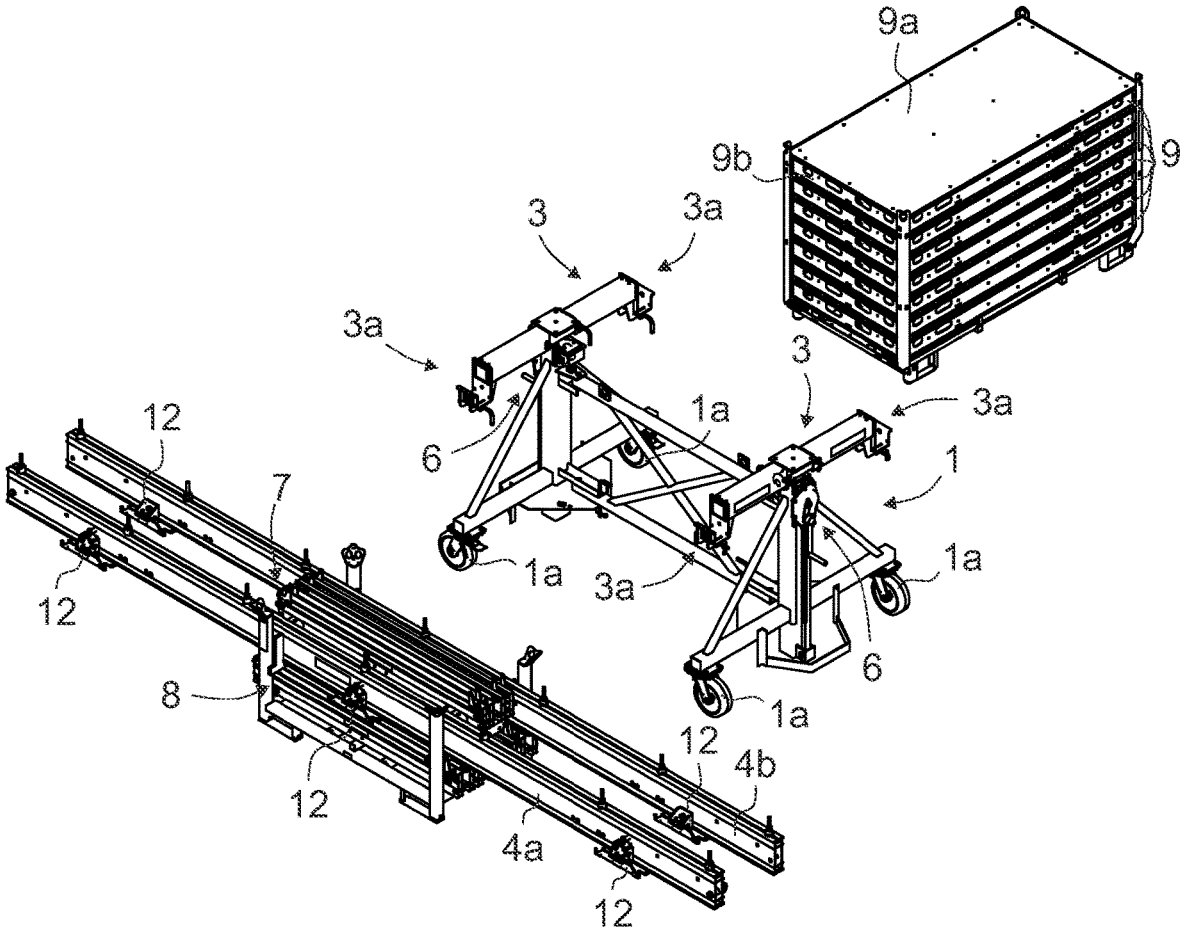
FIG. 1 shows an assembly and shifting trolley for use in a method.
Figure 2:
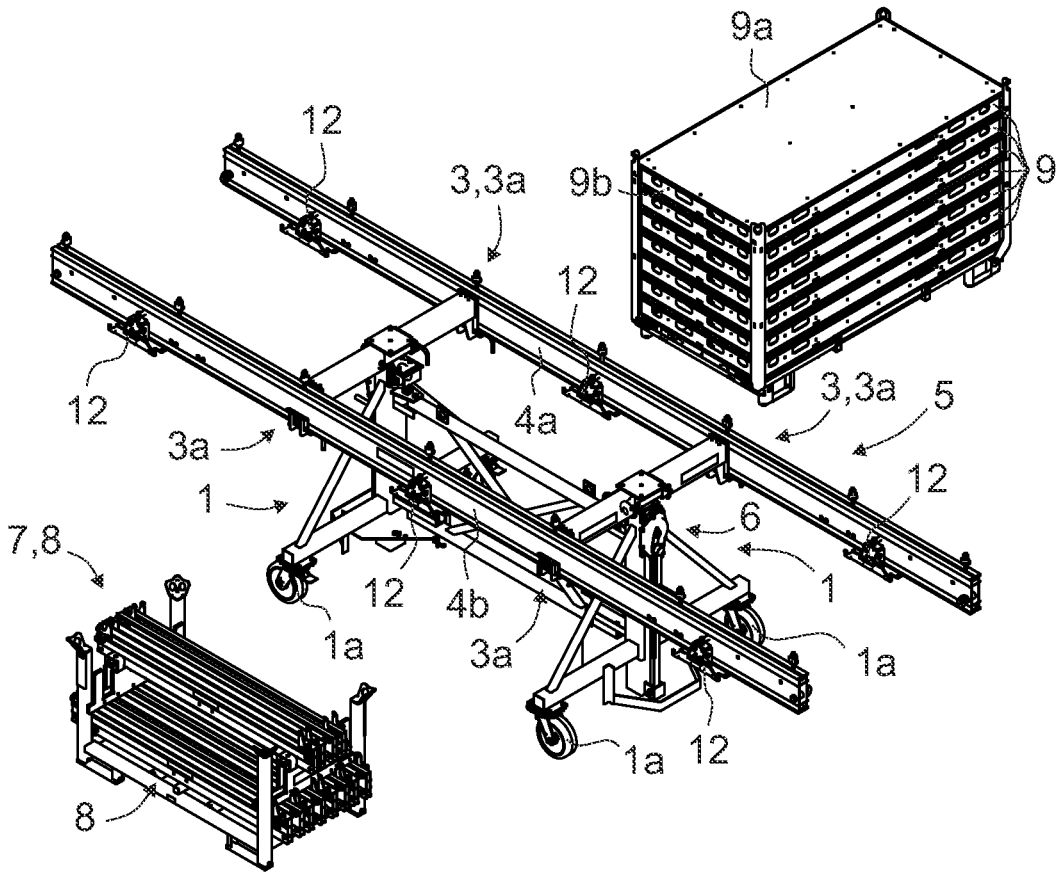
FIGS. 2, 3, 4, and 5 show mounting of the carrier skeleton of the slab table on the receiving device of the shifting trolley.

FIG. 1 shows an assembly and shifting trolley 1 for use in a method according to the invention for assembling or dismantling at least one slab table 2 (see FIGS. 9 and 10) for at least partial formworking of a concrete slab (not shown). The shifting trolley 1 has a raisable and lowerable receiving device 3 which is designed to receive a first main girder 4*a* and a second main girder 4*b* of a carrier skeleton 5, shown in FIGS. 2 through 10, of a slab table 2. The shifting trolley 1 can be provided with at least one winch 6, via which the receiving device 3 can be raised and lowered. Furthermore, the receiving device 3 has holding regions 3*a* which are adapted to a cross-sectional shape of the main girders 4*a*, 4*b*. As can be further seen from FIG. 1, the shifting trolley 1 is provided with rollers 1*a* for movement. The main girders 4*a*, 4*b* are provided with receptacles 12 for at least one support 10.

Figure 9:
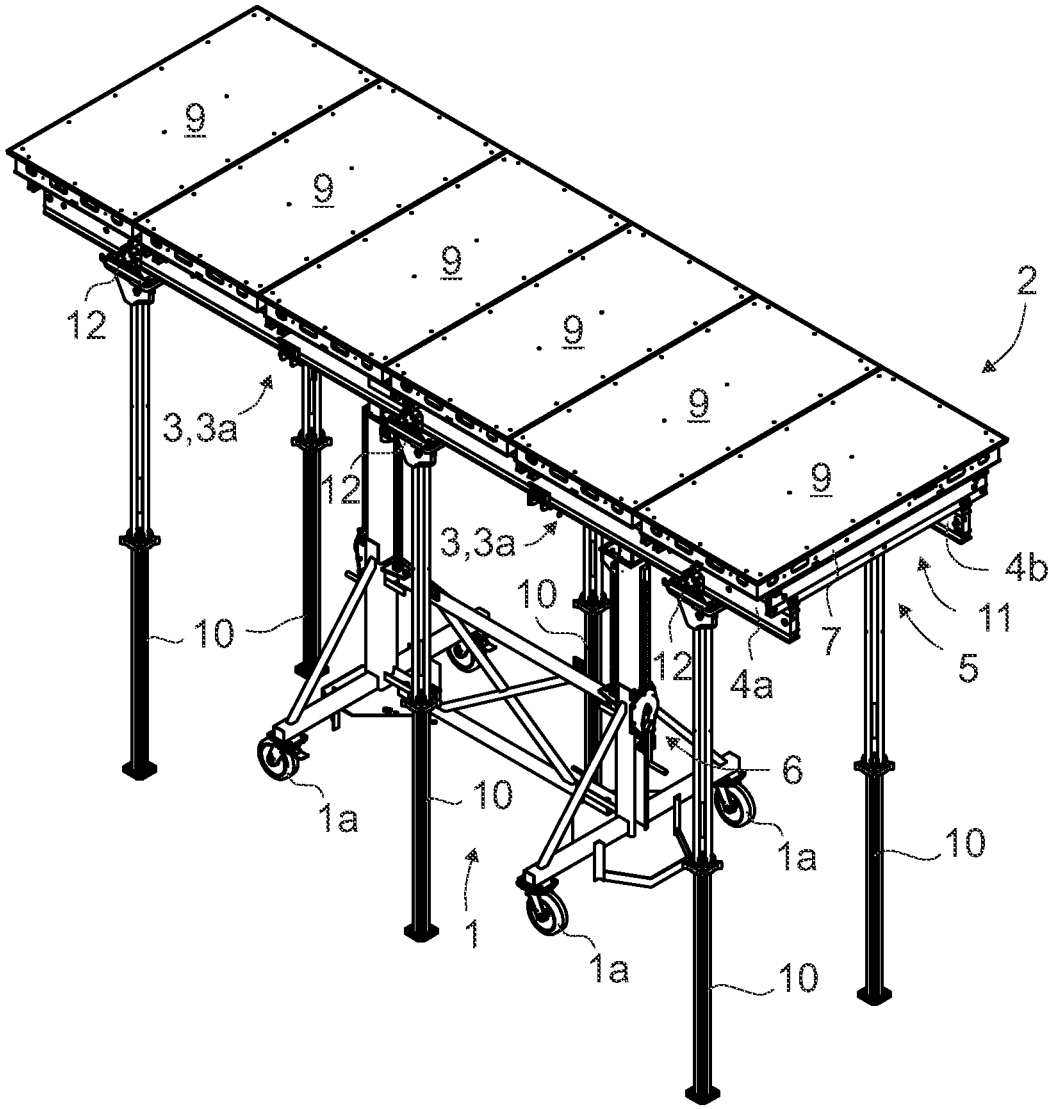
FIG. 9 shows a step of which mounting of the at least one support on an underside of the carrier skeleton of the slab table.
Figure 10:
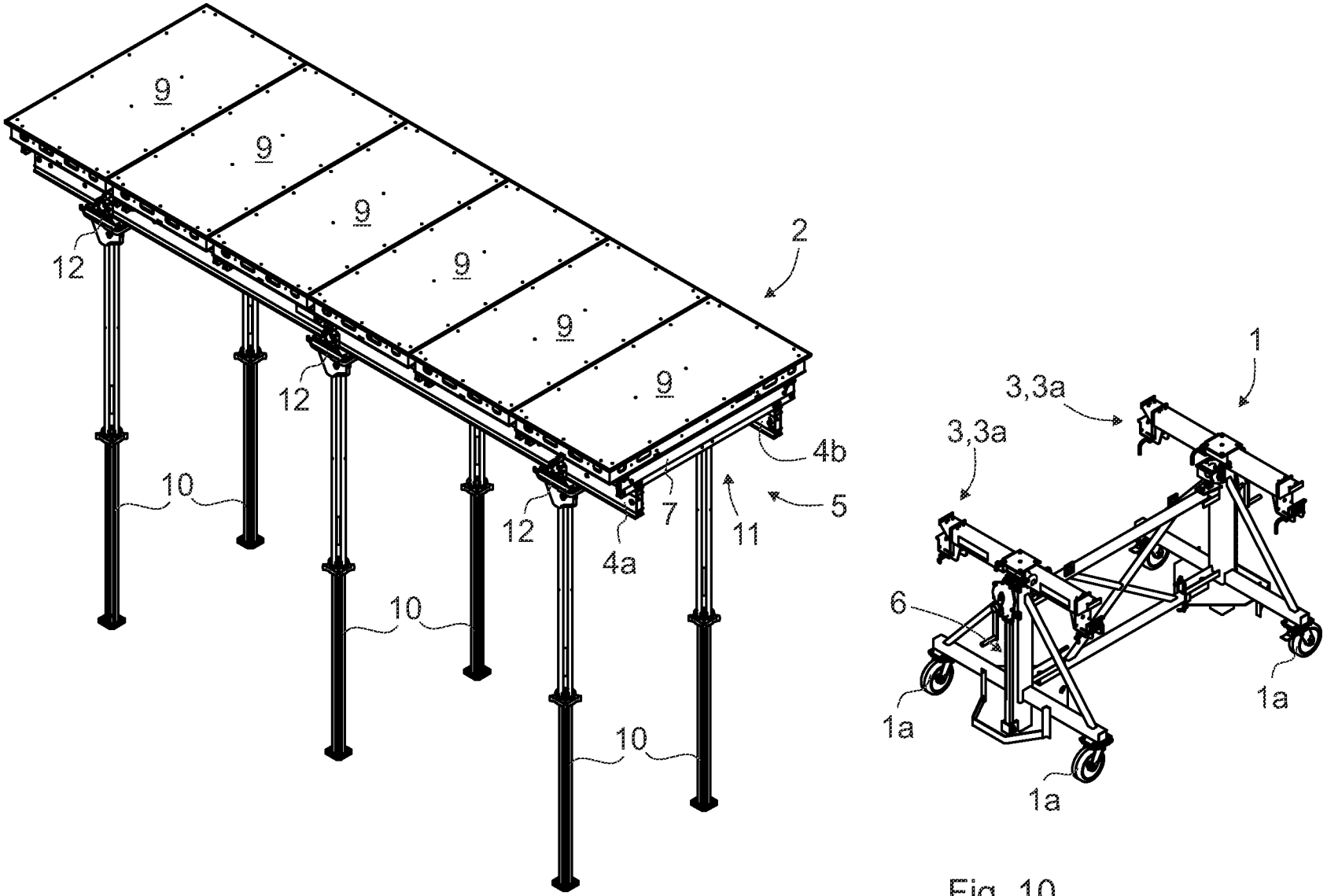
FIG. 10 shows a step in which the receiving device is lowered and the shifting trolley is removed.

In addition, edge girders 7 and central girders 8 for the carrier skeleton 5 are shown in FIG. 1. In addition, a stack having formwork elements 9 is present. To complete the slab table 2, the at least one support 10 is required, which is shown in FIGS. 9 and 10.

According to the invention, a method for assembling at least one slab table 2 for at least partial formworking of a concrete slab is proposed, which has a carrier skeleton 5, at least one formwork element 9, and at least one support 10, wherein the method comprises, in sequence, at least the following steps indicated in FIGS. 1 through 10.

In FIG. 1, in a step a), the—in particular, movable—shifting trolley 1 is provided with the raisable and lowerable receiving device 3, which is designed to receive the carrier skeleton 5 of the slab table 2.

Figure 3:
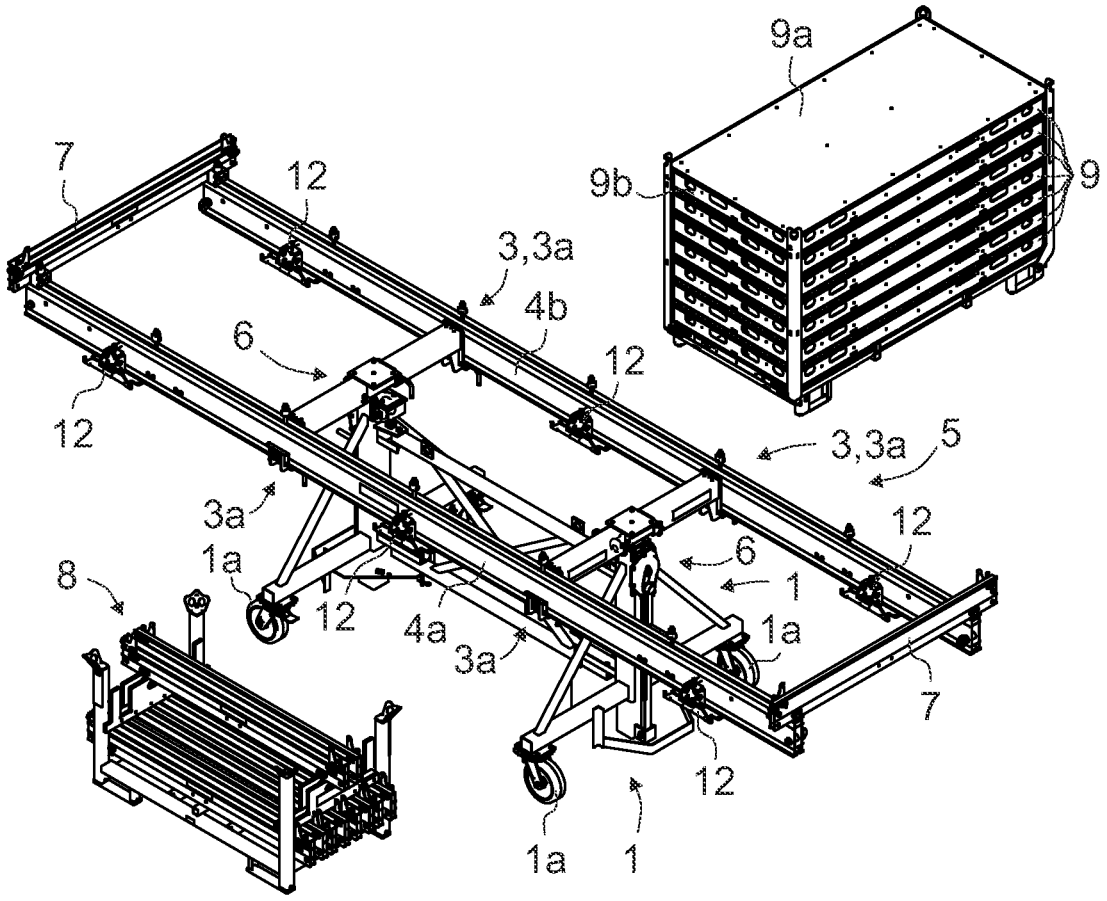

FIGS. 2 through 5 show, as step b), mounting of the carrier skeleton 5 of the slab table 2 on the receiving device 3 of the shifting trolley 1. In this case, in a substep b1) of step b), as shown in more detail in FIG. 2, the first main girder 4*a* and the second main girder 4*b* spaced apart therefrom are arranged in the receiving device 3 of the shifting trolley 1, wherein the longitudinal axis of the first main girder 4*a* runs parallel to the longitudinal axis of the second main girder 4*b*. FIG. 3 shows a substep b2) of step b), in which first and second edge girders 7 are reversibly detachably fastened to the main girders 4*a*, 4*b*, wherein the longitudinal axes of the edge girders 7 run perpendicular to the longitudinal axes of the main girders 4*a*, 4*b*.

Figure 4:
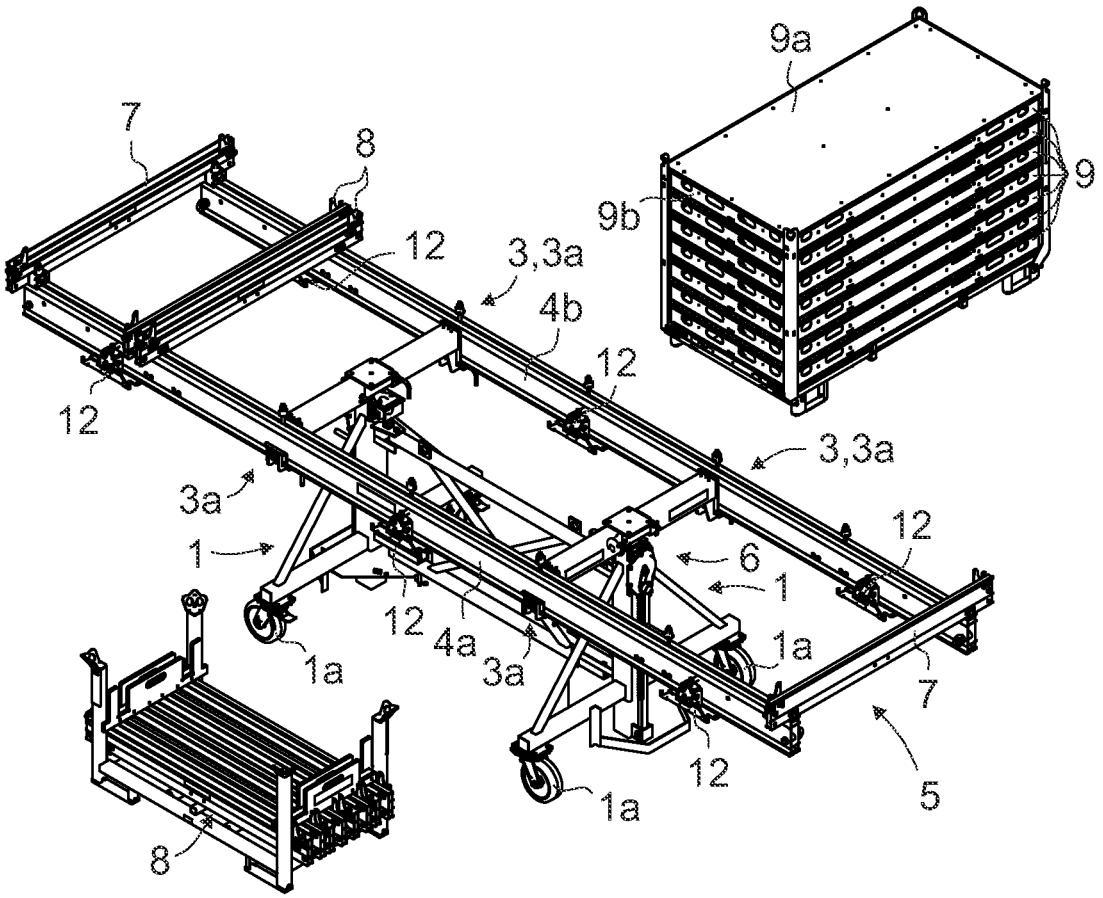
Figure 5:
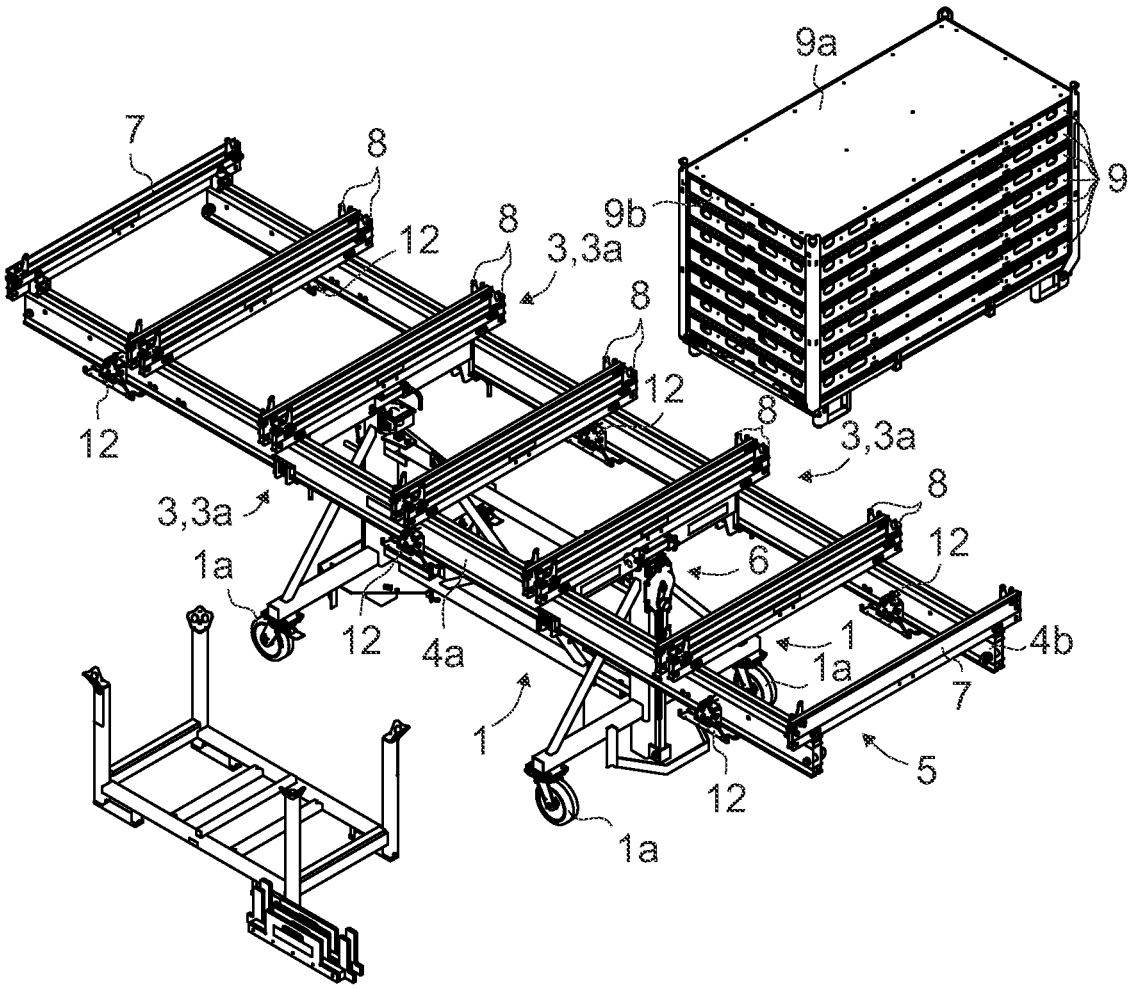

FIGS. 4 and 5 show, as substep b3) of step b), reversibly detachably fastening the at least one central girder 8 to the main girders 4*a*, 4*b*, wherein the longitudinal axis of the central girder 8 runs parallel to the longitudinal axes of the edge girders 7.

Figure 6:
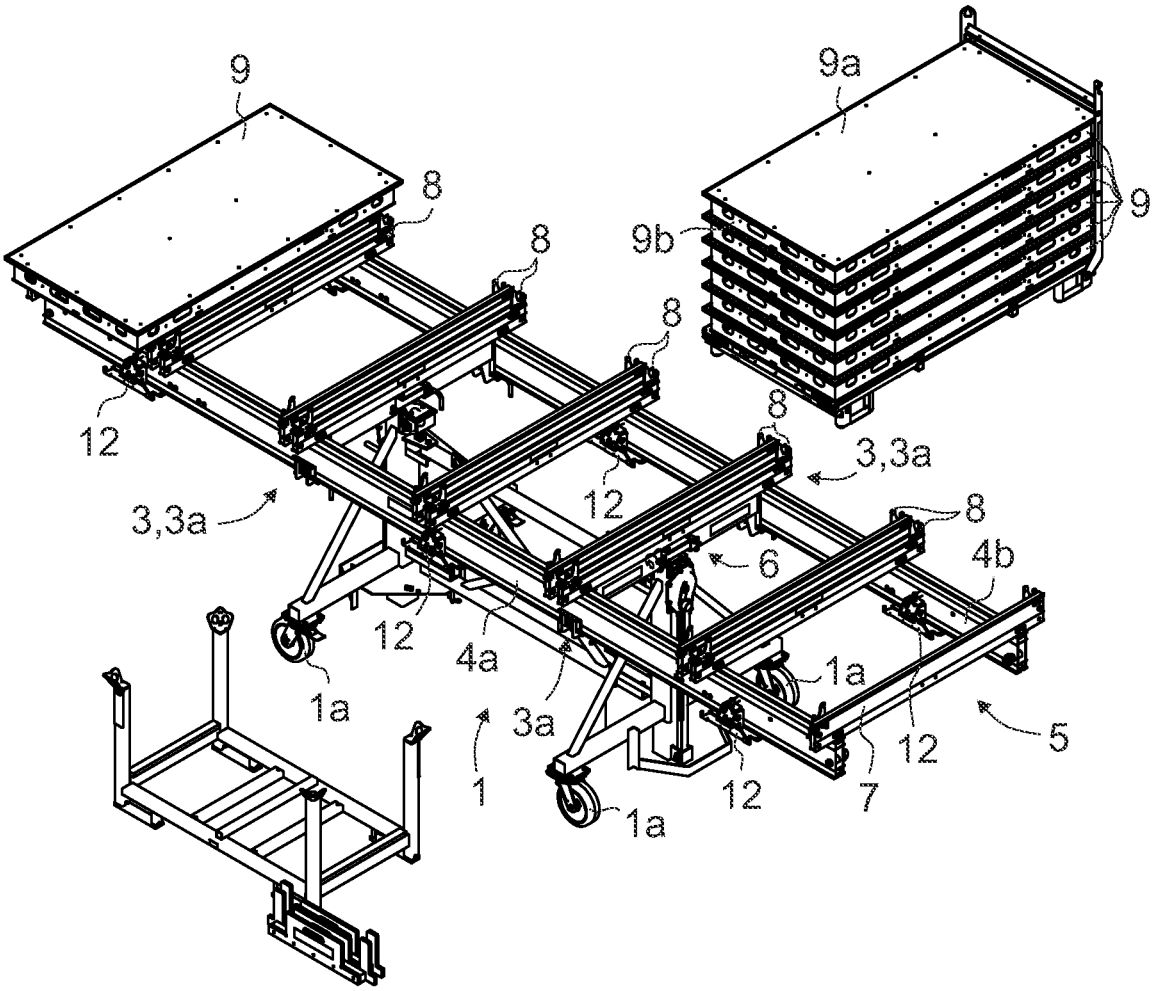
FIGS. 6 and 7 show a step in which the at least one formwork element is fastened to the carrier skeleton of the slab table.
Figure 7:
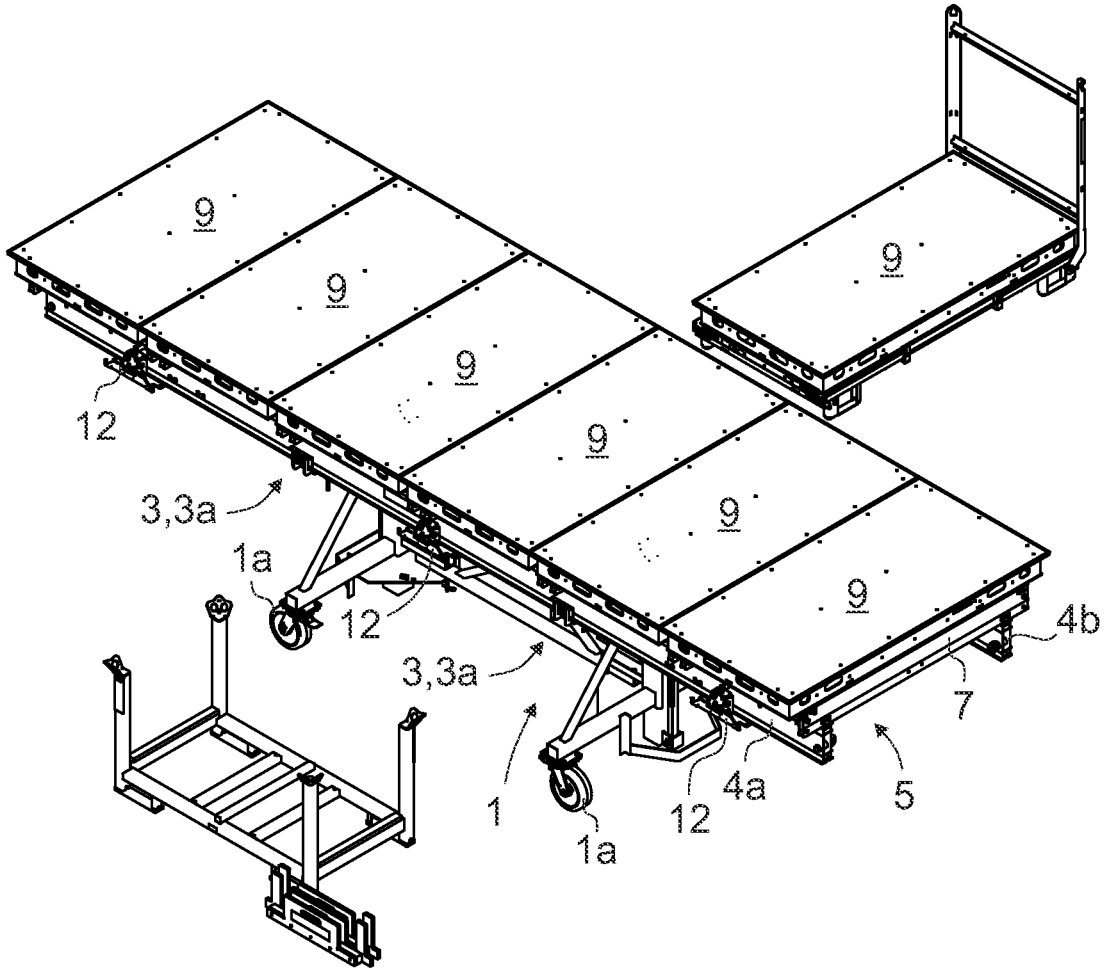

FIGS. 6 and 7 show a step c), in which the at least one formwork element 9 is fastened to the carrier skeleton 5 of the slab table 2. The at least one formwork element 9 has a formwork skin 9*a*, which is arranged on a formwork element frame 9*b*.

Figure 8:
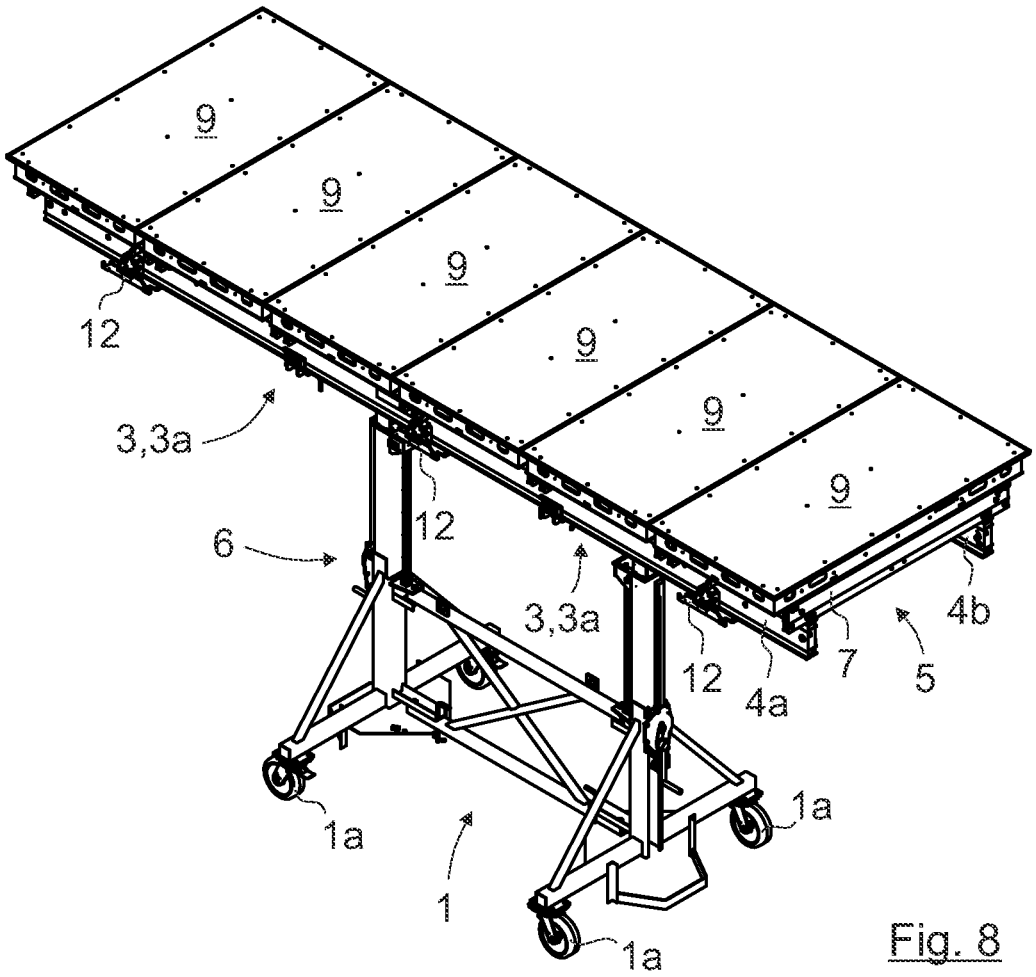
FIG. 8 shows a step in which the carrier skeleton is raised together with the at least one formwork element.

As shown in FIG. 8, in a step d), the carrier skeleton 5 is raised together with the at least one formwork element 9.

Mounting of the at least one support 10 on an underside 11, which faces away from the at least one formwork element 9, of the carrier skeleton 5 of the slab table 2 according to a step e) is shown in FIG. 9. For this purpose, the supports 10 can be introduced into the receptacles 12 of the main girders 4*a*, 4*b*.

In a step f), the shifting trolley 1 is positioned and aligned at the intended mounting location of the slab table 2. In a step g), the slab table 2 is positioned at the installation height by means of the raisable and lowerable receiving device 3 of the shifting trolley 1. Finally, in a step h), the at least one support 10 is adjusted in order to place the slab table 2 on the at least one support 10. Steps f), g), and h) are indicated in FIG. 9.

As can be seen from FIG. 10, in a step i), the receiving device 3 is lowered, and the shifting trolley 1 is removed.

The dismantling of the at least one slab table 2 takes place in the reverse sequence, as it were, by means of the following method steps:

a) providing the—in particular, movable—shifting trolley 1 with the raisable and lowerable receiving device 3, which is designed to receive the carrier skeleton 5 of the slab table 2;

b) positioning and aligning the shifting trolley at the installation location of the slab table 2 to be dismantled;

c) positioning the raisable and lowerable receiving device 3 at the mounting height of the slab table 2, and receiving the carrier skeleton 5 of the slab table 2 in the receiving device 3 of the shifting trolley 1;

d) dismantling the at least one support 10;

e) lowering the carrier skeleton 5, provided with the at least one formwork element 9, of the slab table 2 to a working height;

f) dismantling the at least one formwork element 9;

g) dismantling the carrier skeleton 5 of the slab table 2, wherein central girders 8, edge girders 7, and the main girders 4*a*, 4*b* are dismantled; and h) removing the shifting trolley 1.

LIST OF REFERENCE SIGNS

1 shifting trolley
1*a* rollers
2 slab table
3 receiving device
3*a* holding regions
4*a* first main girder
4*b* second main girder
5 carrier skeleton
6 winch
7 edge girder
8 center girder
9 formwork element
10 support
11 underside of the carrier skeleton
12 receptacles of the main girders

The invention claimed is:

1. A method for assembling and disassembling at least one slab table for at least partial formworking of a concrete slab, which has a carrier skeleton, at least one formwork element, and at least one support, wherein the method of assembly comprises, in sequence, at least:

providing a shifting trolley having a raisable and lowerable receiving device which is configured to receive the carrier skeleton of the slab table;

mounting the carrier skeleton of the slab table on the receiving device of the shifting trolley;

reversibly detachably fastening the at least one formwork element to the carrier skeleton of the slab table;

raising the carrier skeleton together with the at least one formwork element;

mounting the at least one support on an underside, facing away from the at least one formwork element, of the carrier skeleton of the slab table;

positioning and aligning the shifting trolley at the intended mounting location of the slab table;

positioning the slab table at the mounting height by means of the raisable and lowerable receiving device;

adjusting the at least one support in order to place the slab table on the at least one support; and lowering the receiving device and removing the shifting trolley wherein the method of dismantling comprises:

providing a shifting trolley having a raisable and lowerable receiving device which is configured to receive the carrier skeleton of the slab table;

positioning and aligning the shifting trolley at the installation location of the slab table to be dismantled;

positioning the raisable and lowerable receiving device at the mounting height of the slab table and receiving the carrier skeleton of the slab table in the receiving device of the shifting trolley;

dismantling the at least one support;

lowering the carrier skeleton, provided with the at least one formwork element, of the slab table to a working height;

dismantling the at least one formwork element;

disassembling the carrier skeleton of the slab table; and removing the shifting trolley.

2. The method according to claim 1, wherein mounting the carrier skeleton further comprises:

arranging a first main girder and a second main girder spaced apart therefrom in the receiving device of the shifting trolley, wherein the longitudinal axis of the first main girder runs parallel to the longitudinal axis of the second main girder; and reversibly detachably fastening first and second edge girders to the main girders, wherein the longitudinal axes of the edge girders run perpendicular to the longitudinal axes of the main girders.

3. The method according to claim 2, wherein mounting the carrier skeleton further comprises:

reversibly detachably fastening at least one central girder to the main girders, wherein the longitudinal axis of the central girder runs parallel to the longitudinal axes of the edge girders.

4. A shifting trolley for use in the method according to claim 1, comprising: a raisable and lowerable receiving device which is configured to receive a first main girder and a second main girder of a carrier skeleton of a slab table.

5. The shifting trolley according to claim 4, further comprising at least one winch, via which the receiving device can be raised and lowered.

6. The shifting trolley according to claim 4, wherein the receiving device has a plurality of holding regions which are adapted to a cross-sectional shape of the main girders.

7. The method of claim 1, wherein the shifting trolley is movable.

8. A method for assembling and disassembling at least one slab table for at least partial formworking of a concrete slab, which has a carrier skeleton, at least one formwork element, and at least one support, wherein the method of assembling comprises, in sequence, at least: a) providing a shifting trolley having a raisable and lowerable receiving device which is configured to receive the carrier skeleton of the slab table; b) mounting the carrier skeleton of the slab table on the receiving device of the shifting trolley; c) reversibly detachably fastening the at least one formwork element to the carrier skeleton of the slab table; d) raising the carrier skeleton together with the at least one formwork element; e) mounting the at least one support on an underside, facing away from the at least one formwork element, of the carrier skeleton of the slab table; f) positioning and aligning the shifting trolley at the intended mounting location of the slab table; g) positioning the slab table at the mounting height by means of the raisable and lowerable receiving device; h) adjusting the at least one support in order to place the slab table on the at least one support; and i) lowering the receiving device and removing the shifting trolley, wherein b) further comprises: b1) arranging a first main girder and a second main girder spaced apart therefrom in the receiving device of the shifting trolley, wherein the longitudinal axis of the first main girder runs parallel to the longitudinal axis of the second main girder; and b2) reversibly detachably fastening first and second edge girders to the main girders, wherein the longitudinal axes of the edge girders run perpendicular to the longitudinal axes of the main girders; wherein the method of disassembling comprises: j) providing a shifting trolley having a raisable and lowerable receiving device which is configured to receive the carrier skeleton of the slab table; k) positioning and aligning the shifting trolley at the installation location of the slab table to be dismantled; l) positioning the raisable and lowerable receiving device at the mounting height of the slab table and receiving the carrier skeleton of the slab table in the receiving device of the shifting trolley; m) dismantling the at least one support; n) lowering the carrier skeleton, provided with the at least one formwork element, of the slab table to a working height; o) dismantling the at least one formwork element; p) disassembling the carrier skeleton of the slab table; and q) removing the shifting trolley.

* * * * *